US008166963B2

(12) United States Patent
Leven

(10) Patent No.: US 8,166,963 B2
(45) Date of Patent: May 1, 2012

(54) ACCESSORY PLATFORM FOR ARCHERY BOWS

(75) Inventor: William L. Leven, Lancaster, CA (US)

(73) Assignee: Leven Industries, Lancaster, CA (US)

( * ) Notice: Subject to any disclaimer, the term of this patent is extended or adjusted under 35 U.S.C. 154(b) by 369 days.

(21) Appl. No.: 12/589,532

(22) Filed: Mar. 9, 2009

(65) Prior Publication Data

US 2010/0242940 A1 Sep. 30, 2010

(51) Int. Cl.
*F41B 5/20* (2006.01)

(52) U.S. Cl. ..... 124/89; 124/86

(58) Field of Classification Search ..... 124/89, 124/90, 92, 86, 88
See application file for complete search history.

(56) References Cited

U.S. PATENT DOCUMENTS

| | | | | | |
|---|---|---|---|---|---|
| 1,560,655 | A | * | 11/1925 | Brewster | 267/219 |
| 2,239,077 | A | * | 4/1941 | Burton et al. | 295/11 |
| 2,735,243 | A | * | 2/1956 | Allison | 451/544 |
| 2,815,618 | A | * | 12/1957 | Buliga | 451/511 |
| 3,060,836 | A | * | 10/1962 | Varney | 99/302 R |
| 4,054,121 | A | * | 10/1977 | Hoyt, Jr. | 124/89 |
| 4,310,999 | A | * | 1/1982 | Onoue | 56/295 |
| 5,090,396 | A | * | 2/1992 | Bickel et al. | 124/89 |
| 5,450,673 | A | * | 9/1995 | Denton | 33/265 |
| 5,700,198 | A | * | 12/1997 | Takano | 464/71 |
| 2007/0079821 | A1 | * | 4/2007 | Walk et al. | 124/86 |

* cited by examiner

*Primary Examiner* — John Ricci
(74) *Attorney, Agent, or Firm* — DLA Piper LLP (US)

(57) ABSTRACT

An accessory platform for archery bows is provided. The accessory platform includes a substantially disk-shaped portion provided with a hole in the center thereof, a plurality of holes are provided around a periphery of the disk-shaped portion and a base cushion is provided in the hole and includes means to couple the disk-shaped portion directly or indirectly to an archery bow. The accessory platform is utilized to absorb vibration when an arrow is shot from the archery bow and to balance the weight of the archery bow.

3 Claims, 3 Drawing Sheets

ACCESSORY PLATFORM FOR ARCHERY BOWS

FIELD OF THE INVENTION

The present invention relates to accessories and devices designed to absorb the vibrations generated when an arrow is shot from a bow and to balance the bow to the user's requirements.

BACKGROUND OF THE INVENTION

In the prior art there exists several devices for absorbing vibration of the bow during the time period when an arrow is shot from the bow. In addition, some of these devices are also capable to some extent of balancing the bow. Such prior art devices can be found in issued United States patent numbers:

| | |
|---|---|
| 4,135,486 | 4,370,670 |
| 5,273,022 | 6,526,957 |
| 6,802,307 | 6,997,174 |
| 7,318,430 | |

While the devices described in the above-identified United States patents may absorb vibration and balance the bow to some extent, they all have one or more defects such as being heavy, cumbersome, being affected by the wind and providing limited adjustability.

INCORPORATION BY REFERENCE

Applicant incorporates by reference all of Provisional Application No. 61/209,595.

SUMMARY OF THE INVENTION

Accordingly, it is a general object of the present invention to overcome the deficiencies of the prior art.

In particular, it is an object of the present invention to provide an accessory platform for an archery bow which not only absorbs the vibration but also provides substantial adjustability in balancing the bow to the user's specifications.

In keeping with the principals and objects of the present invention, the above described objects are accomplished by a unique accessory platform for archery bows. The accessory platform includes a substantially disk-shaped portion provided with a hole in the center thereof, a plurality of holes are provided around a periphery of the disk-shaped portion and a base cushion is provided in the hole and includes means to couple the disk-shaped portion directly or indirectly to an archery bow. This accessory platform is utilized to absorb vibration when an arrow is shot from an archery bow and to balance the weight of the archery bow pursuant to the requirements of the user.

IN THE DRAWINGS

The above mentioned features and objects will become more apparent with reference to the following description taken in conjunction with the accompanied drawings wherein like referenced numerals described like elements and in which.

DETAILED DESCRIPTION OF THE INVENTION

Figure 1A:
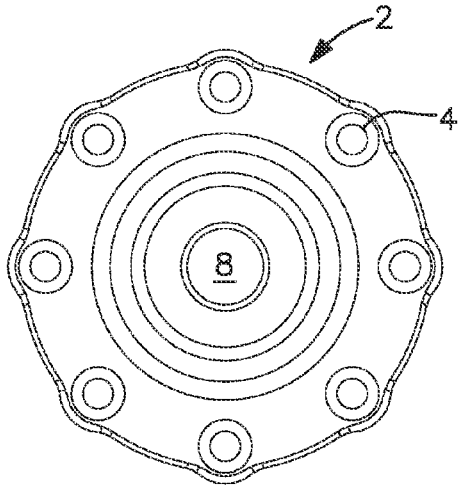
FIGS. 1A, 1B and 1C are top, side and bottom views of one component of the present invention.
Figure 1B:
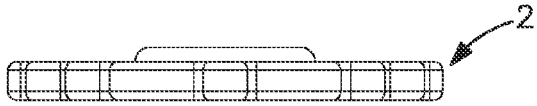
Figure 1C:
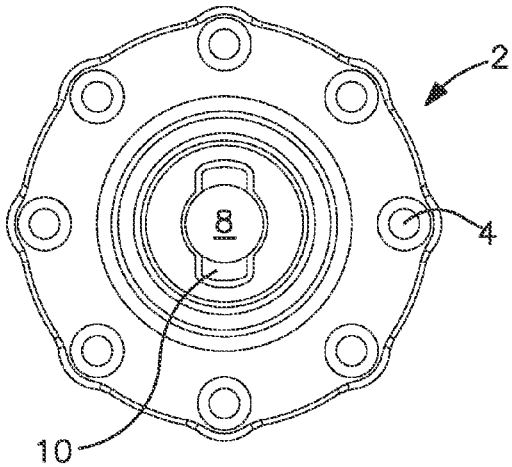

Referring to the FIGS. 1A, 1B, 1C, 2, 3A and 3B, shown therein are the basic components of the accessory platform of the present invention. In particular, the present invention comprises a disk 2, thus is shown in the FIGS. 1A through 1C. The disk 2 can be made from a hard or pliable material such as a metal, plastic or elastomer. The disk 2 is generally disk-shaped, but could be provided in other shapes depending on the application such as a star shape, a square, a hexagon, etc. and could be made in various diameters. Around the periphery of the disk 2 is a plurality of mounting holes 4. These mounting holes 4 are for the purpose of mounting other elements to the disk 2 and the primary elements which might be added to the disk 2 are weights 6 such as are shown in FIG. 4. The weights 6 may be provided in each one of the mounting holes or depending on the balance desired by the user, again be provided in only one hole or any other number of holes and positions which the user may desire in order to provide the proper balance. Still further, the holes 4 may be threaded or unthreaded of all the same or different sizes, and of various numbers, depending on the application.

The disk 2 is further provided at its center with a hole 8. The hole 8 may be further provided with radially extending notches 10 on a bottom surface of the disk 2. These notches 10 are utilized to prevent the disk 2 from rotating on its mounting.

Figure 2:
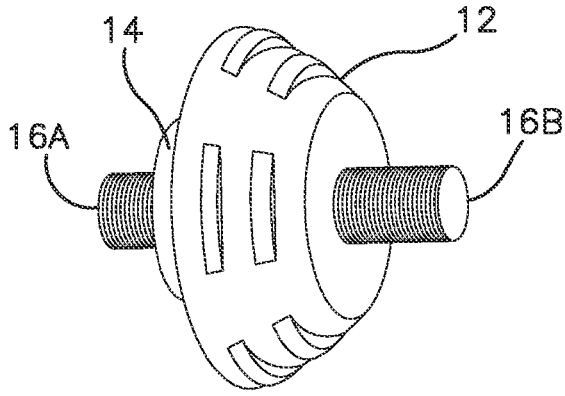
FIG. 2 is a perspective view of one portion of another part of the present invention.
Figure 3A:
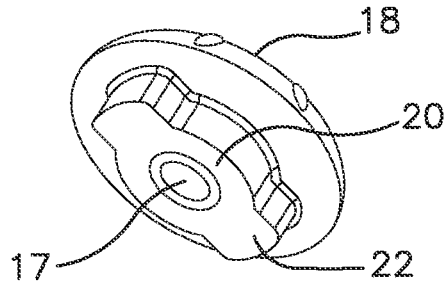
FIGS. 3A and 3B are perspective views of still another portion of the present invention.
Figure 3B:
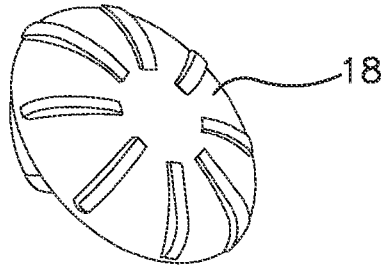
Figure 4:
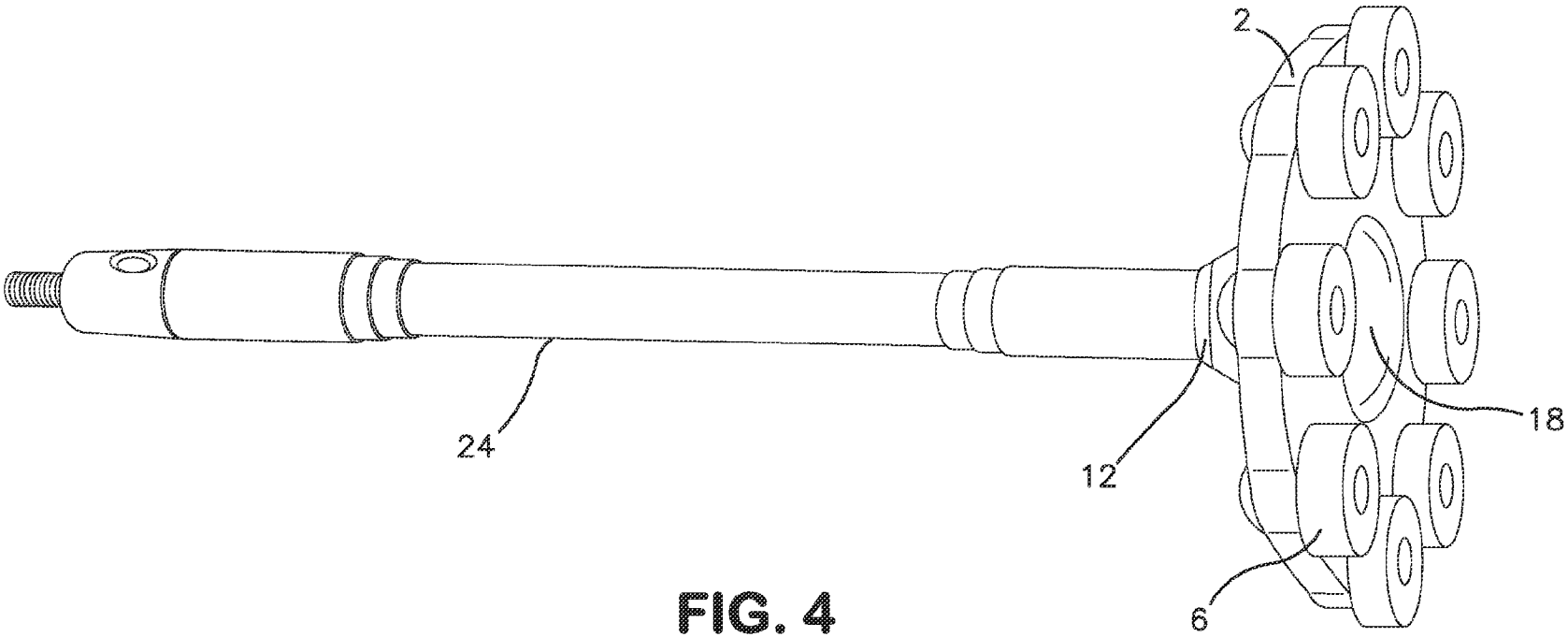
FIG. 4 is a perspective view of the present invention in use.

A cushion base comprising two parts shown in the FIGS. 2, 3A and 3B. The cushion base comprises a lower portion 12 which has a raised portion 14 which fits into the hole 8 from the bottom side of the disk 2. The bottom portion 12 is provided with the threaded means 16A and 16B provided on both sides of the lower base 12. The two threaded mounting means 16A and 16B are not connected to each other and are separate elements and are molded or installed into the lower base 12. Screw mounting 16*a* threads into a hole 17 in the upper base 18 so as to mount the lower base 14 and the upper base 18 together. The upper base 18 is further provided with a projecting portion 20 which includes projecting tabs 22. The projecting tabs 22 fit into the notches 10 in the disk 2 and together with the notches 10 prevent the disk 2 from rotating. Still further, the upper and lower base portions 18 and 12 are made from a shock absorbing material such as an elastomer and such elastomer can be 35 to 80 duro depending on the application.

In operation and as is shown in FIG. 4, the disk 2 with weights 6 can be attached to a stabilizer 24 of an archery bow by means of the top threaded portion 16B. The stabilizer 24 can then be attached to an archery bow, not shown. Still further and in other applications, the disk 2 may be attached by means of the cushion base directly to an archery bow, again not shown, without the utilization of a stabilizer. One or more weights 6 are provided on the disk 2 in whatever configuration the user desires in order to balance the archery bow to the user's specifications. It should be apparent that the disk itself does not function as a weight.

With the stabilizer 24 mounted on the archery bow, not shown, and the disk 2 mounted to the stabilizer 24 by means of the bottom portion 12 of the cushion base, the vibration generated when an arrow is shot from a bow is absorbed by means of the cushion base while the weights 6 provided on the disk 2 maintain the balance of the bow.

While the present invention has been described in terms of a separate cushion base from the disk 2, one of ordinary skill in the art could also make the cushion base and the disk 2 as a single molded part. It should be apparent to those skilled in the art that the above described embodiment is but one of many embodiments which could be made based upon the principals and objects of the present invention without departing from the spirit and scope of the present invention.

The invention claimed is:

1. An accessory platform for archery bows comprising:

a substantially disk-shaped article provided with a hole in the center thereof;

a plurality of holes provided around a periphery of said article; and a base cushion provided in said hole in said center of said disk-shaped article and including means to couple said article to said archery bow, said base cushion for isolating said article from said archery bow; and wherein said hole in said center of said disk-shaped article is provided with at least one notch and said base cushion is provided with at least one projection which fits into said notch for preventing rotation of said disk.

2. The accessory platform according to claim 1, wherein said disk-shaped article is made from a material selected from the group consisting of metal, plastic and elastomers.

3. The accessory platform according to claim 2, wherein said base cushion is made from an elastomer of 35 to 80 duro.

* * * * *